US011937646B2

(12) United States Patent
Potter et al.

(10) Patent No.: US 11,937,646 B2
(45) Date of Patent: Mar. 26, 2024

(54) VAPOR PROVISION SYSTEM

(71) Applicant: NICOVENTURES TRADING LIMITED, London (GB)

(72) Inventors: Mark Potter, London (GB); Wade Tipton, London (GB); William Harris, London (GB); Christopher Rowe, London (GB); James Davies, London (GB); James Boonzaier, London (GB); Conor Devine, London (GB)

(73) Assignee: NICOVENTURES TRADING LIMITED, London (GB)

( * ) Notice: Subject to any disclaimer, the term of this patent is extended or adjusted under 35 U.S.C. 154(b) by 915 days.

(21) Appl. No.: 15/733,416

(22) PCT Filed: Jan. 14, 2019

(86) PCT No.: PCT/GB2019/050089
§ 371 (c)(1),
(2) Date: Jul. 23, 2020

(87) PCT Pub. No.: WO2019/145676
PCT Pub. Date: Aug. 1, 2019

(65) Prior Publication Data

US 2021/0093010 A1 Apr. 1, 2021

(30) Foreign Application Priority Data

Jan. 24, 2018 (GB) ..... 1801145

(51) Int. Cl.
*A24F 40/48* (2020.01)
*A24F 40/42* (2020.01)
(Continued)

(52) U.S. Cl.
CPC ..... *A24F 40/485* (2020.01); *A24F 40/42* (2020.01); *A24F 40/44* (2020.01); *A24F 40/10* (2020.01)

(58) Field of Classification Search
None
See application file for complete search history.

(56) References Cited

U.S. PATENT DOCUMENTS 8,061,361 B2 11/2011 Maeder et al.
9,254,007 B2 * 2/2016 Liu ..... A24F 40/46
(Continued)

FOREIGN PATENT DOCUMENTS

CN 201781984 U 4/2011
CN 201830900 U 5/2011
(Continued)

OTHER PUBLICATIONS

English translation of WO 2017/015832, Liu, Qiuming, Feb. 2, 2017 (Year: 2017).*
(Continued)

*Primary Examiner* — Ross N Gushi
(74) *Attorney, Agent, or Firm* — Husch Blackwell LLP

(57) ABSTRACT

A vapor provision system including a vapor generation chamber, a reservoir containing liquid, a vaporizer located in the vapor generation chamber and a liquid transport element arranged to transport liquid from the reservoir through an opening in a wall of the vapor generation chamber to the vaporizer, wherein the liquid transport element in the vapor generation chamber has a cross-sectional area which is greater than that of the opening, and wherein the liquid transport element in the vapor generation chamber abuts the wall surrounding the opening to help prevent leakage.

20 Claims, 5 Drawing Sheets

(51) Int. Cl.

| | |
|---|---|
| ***A24F 40/44*** | (2020.01) |
| ***A24F 40/485*** | (2020.01) |
| *A24F 40/10* | (2020.01) |

(56) References Cited

U.S. PATENT DOCUMENTS

| | | | | |
|---|---|---|---|---|
| 10,258,087 | B2 | 4/2019 | Kane | |
| 11,213,638 | B2 | 1/2022 | Netterstrom et al. | |
| 11,388,931 | B2 | 7/2022 | Potter et al. | |
| 2011/0005535 | A1 | 1/2011 | Xiu | |
| 2013/0081642 | A1 | 4/2013 | Safari | |
| 2013/0087160 | A1 | 4/2013 | Gherghe | |
| 2013/0228191 | A1 | 9/2013 | Newton | |
| 2013/0263869 | A1 | 10/2013 | Zhu | |
| 2013/0306065 | A1 | 11/2013 | Thorens et al. | |
| 2014/0123989 | A1 | 5/2014 | Lamothe | |
| 2014/0130816 | A1 | 5/2014 | Liu | |
| 2014/0238423 | A1 | 8/2014 | Tucker et al. | |
| 2014/0238424 | A1 | 8/2014 | Macko et al. | |
| 2015/0040927 | A1 | 2/2015 | Li et al. | |
| 2015/0144145 | A1 | 5/2015 | Chang et al. | |
| 2016/0015081 | A1 | 1/2016 | Liu | |
| 2016/0015082 | A1 | 1/2016 | Liu | |
| 2016/0073692 | A1* | 3/2016 | Alarcon | A24F 40/44 131/329 |
| 2016/0121058 | A1 | 5/2016 | Chen | |
| 2016/0278163 | A1 | 9/2016 | Chen | |
| 2016/0286863 | A1 | 10/2016 | Lin | |
| 2016/0345632 | A1 | 12/2016 | Lipowicz | |
| 2017/0042242 | A1 | 2/2017 | Hon | |
| 2017/0127725 | A1 | 5/2017 | Buchberger et al. | |
| 2017/0273359 | A1 | 9/2017 | Liu | |
| 2017/0303596 | A1 | 10/2017 | Chen | |
| 2020/0352238 | A1 | 11/2020 | Simpson et al. | |
| 2021/0145055 | A1 | 5/2021 | Potter et al. | |

FOREIGN PATENT DOCUMENTS

| | | | |
|---|---|---|---|
| CN | 103380952 | A | 11/2013 |
| CN | 204120237 | U | 1/2015 |
| CN | 104366695 | A | 2/2015 |
| CN | 104720117 | A | 6/2015 |
| CN | 204426699 | U | 7/2015 |
| CN | 204483035 | U | 7/2015 |
| CN | 105163614 | A | 12/2015 |
| CN | 105188428 | A | 12/2015 |
| CN | 105208882 | A | 12/2015 |
| CN | 105342010 | A | 2/2016 |
| CN | 105433442 | A | 3/2016 |
| CN | 205285008 | U | 6/2016 |
| CN | 205512338 | U | 8/2016 |
| CN | 106376976 | A | 2/2017 |
| CN | 106535682 | A | 3/2017 |
| CN | 206119177 | U | 4/2017 |
| CN | 206197019 | U | 5/2017 |
| CN | 206197020 | U | 5/2017 |
| CN | 107708452 | A | 2/2018 |
| EP | 2460424 | A1 | 6/2012 |
| EP | 2823720 | A1 | 1/2015 |
| EP | 2959784 | A1 | 12/2015 |
| EP | 2984952 | A1 | 2/2016 |
| EP | 3108759 | A1 | 12/2016 |
| GB | 2513639 | A | 11/2014 |
| JP | 2017514504 | A | 6/2017 |
| KR | 20120098343 | A | 9/2012 |
| KR | 20140002774 | U | 5/2014 |
| RU | 2425608 | C2 | 8/2011 |
| RU | 2606572 | C2 | 1/2017 |
| RU | 2620754 | C2 | 5/2017 |
| RU | 2639972 | C2 | 12/2017 |
| WO | WO-2011146375 | A2 | 11/2011 |
| WO | 2016041209 | A1 | 3/2016 |
| WO | WO-2016079151 | A1 | 5/2016 |
| WO | 2016090531 | A1 | 6/2016 |
| WO | WO-2016176800 | A1 | 11/2016 |
| WO | WO-2016190222 | A1 | 12/2016 |
| WO | WO-2016198417 | A1 | 12/2016 |
| WO | WO-2016207357 | A1 | 12/2016 |
| WO | WO-2016208756 | A1 | 12/2016 |
| WO | WO-2017001818 | A1 | 1/2017 |
| WO | WO-2017001819 | A1 | 1/2017 |
| WO | WO-2017015832 | A1 | 2/2017 |
| WO | WO-2017215221 | A1 | 12/2017 |

OTHER PUBLICATIONS

Communication pursuant to Article 94(3) EPC for Application No. 18715070.1, dated Nov. 2, 2020, 21 pages.
International Preliminary Report on Patentability for Application No. PCT/GB2018/050726, dated Jul. 3, 2019, 32 pages.
International Preliminary Report on Patentability for Application No. PCT/GB2019/050037, dated May 8, 2020, 21 pages.
International Preliminary Report on Patentability for Application No. PCT/GB2019/050186, dated May 8, 2020, 8 pages.
International Preliminary Report on Patentability for Application No. PCT/GB2019/050187 dated Aug. 6, 2020, 8 pages.
International Preliminary Report on Patentability for Application No. PCT/GB2019/050187 dated Jul. 28, 2020, 7 pages.
International Search Report and Written Opinion for Application No. PCT/GB2018/050726, dated Jun. 12, 2018, 15 pages.
International Search Report and Written Opinion for Application No. PCT/GB2019/050037, dated Mar. 25, 2019, 12 pages.
International Search Report for Application No. PCT/GB2019/050187, dated Apr. 18, 2019, 3 pages.
Notice of Reasons for Rejection for Japanese Application No. 2020-539826, dated Jun. 15, 2021, 14 pages.
Office Action for Canadian Application No. 3089292, dated Dec. 16, 2021, 6 pages.
Office Action For Chinese Application No. 201880020522.4, dated Aug. 3, 2021, 14 pages.
Office Action For Chinese Application No. 201880020522.4, dated May 20, 2022, 12 pages.
Office Action for Japanese Patent Application No. 2020-537201, dated Jul. 13, 2021, 5 pages.
Office Action For Korean Application No. 10-2019-7027899, dated Jan. 18, 2021, 17 pages.
Office Action For Korean Application No. 10-2019-7027899, dated Jul. 27, 2021, 15 pages.
Office Action For Russian Application No. 2020124567, dated Jan. 28, 2021, 2 pages.
Search Report for Russian Application No. 2020124379 dated Mar. 2, 2021, 2 pages.
Search Report dated Apr. 27, 2017 for Great Britain Application No. GB1704674.9, 5 pages.
Search Report dated May 31, 2017 for Great Britain Application No. GB1702861.4, 5 pages.
Second Office Action dated Jan. 20, 2022 for Chinese Application No. 201880020522.4, 17 pages.
"International Search Report and Written Opinion received for PCT Patent Application No. PCT/GB2019/050089, dated Mar. 25, 2019", 10 pages.
"Notice of Allowance received for Korean Patent Application No. 10-2020-7021264, dated Nov. 14, 2022", 6 pages (3 pages of English Translation and 3 pages of Official Copy).
"Office Action received for Chinese Patent Application No. 201980009907.5, dated Nov. 2, 2022", 17 pages (9 pages of English Translation and 8 pages of Official Copy).

* cited by examiner

VAPOR PROVISION SYSTEM

PRIORITY CLAIM

The present application is a National Phase entry of PCT Application No. PCT/GB2019/050089, filed Jan. 14, 2019, which claims priority from GB Patent Application No. 1801145.2, filed Jan. 24, 2018, each of which is hereby fully incorporated herein by reference.

FIELD

The present disclosure relates to vapor provision systems such as nicotine delivery systems, for example electronic cigarettes and the like.

BACKGROUND

Electronic vapor provision systems such as electronic cigarettes (e-cigarettes) generally contain a vapor precursor material, such as a reservoir of a source liquid that often contains a formulation including nicotine (the source liquid is sometimes referred to as e-liquid). During operation, a vapor is generated from the precursor material for inhalation by a user, for example through heat vaporization. Thus, a vapor provision system typically comprises a vapor generation chamber containing a vaporizer, for example a heating element, arranged to vaporize a portion of precursor material to generate vapor in the vapor generation chamber.

As a user inhales on the device, air is drawn into the device through an inlet hole and passes into the vapor generation chamber, where the air mixes with vaporized precursor material to form a condensation aerosol. There is an air channel connecting the vapor generation chamber and an opening in the mouthpiece, so that the air drawn through the vapor generation chamber as a user inhales on the mouthpiece continues along an airflow path to the mouthpiece opening, entraining the vapor for inhalation by the user.

Liquid-based e-cigarettes, including both liquid-only electronic cigarettes and hybrid devices (electronic cigarettes with tobacco or another flavor element separate from the vapor precursor material), typically have a capillary wick for transporting liquid from within a liquid reservoir to the vapor generation chamber. The wick passes through an opening in a wall that separates the liquid reservoir from the vapor generation chamber. The vaporizer is often formed of a wire heating coil wrapped around the wick. As a user inhales, electrical power is supplied to the coil heater, which vaporizes liquid from the wick. The wick then acts to draw more liquid from the reservoir, for further vaporization and inhalation by a user.

Existing e-cigarettes sometimes suffer from leakage of liquid at the opening where the wick passes through from the reservoir into the vapor generation chamber. This liquid may then travel along the airflow path, for example passing out through the mouthpiece opening or air inlet. The loss of such liquid is wasteful, and generally unappealing for users. Furthermore, as the liquid travels through the device, it may potentially damage or corrode the internal components of the e-cigarette.

SUMMARY

As disclosed herein, a vapor provision system comprises a vapor generation chamber; a reservoir containing liquid; a vaporizer located in the vapor generation chamber; and a liquid transport element arranged to transport liquid from the reservoir through an opening in a wall of the vapor generation chamber to the vaporizer. The liquid transport element in the vapor generation chamber has a cross-sectional area which is greater than that of the opening and abuts the wall surrounding the opening to help prevent leakage.

Also disclosed herein, a vapor provision device is configured to receive a reservoir containing liquid. The device comprises a vapor generation chamber; a vaporizer located in the vapor generation chamber; and a liquid transport element arranged to transport liquid from the reservoir through an opening in a wall of the vapor generation chamber to the vaporizer. The liquid transport element in the vapor generation chamber has a cross-sectional area which is greater than that of the opening. The liquid transport element in the vapor generation chamber abuts the wall surrounding the opening to help prevent leakage.

BRIEF DESCRIPTION OF THE DRAWINGS

Various embodiments will now be described, by way of example only, with reference to the accompanying drawings, in which.

DETAILED DESCRIPTION

Figure 1:
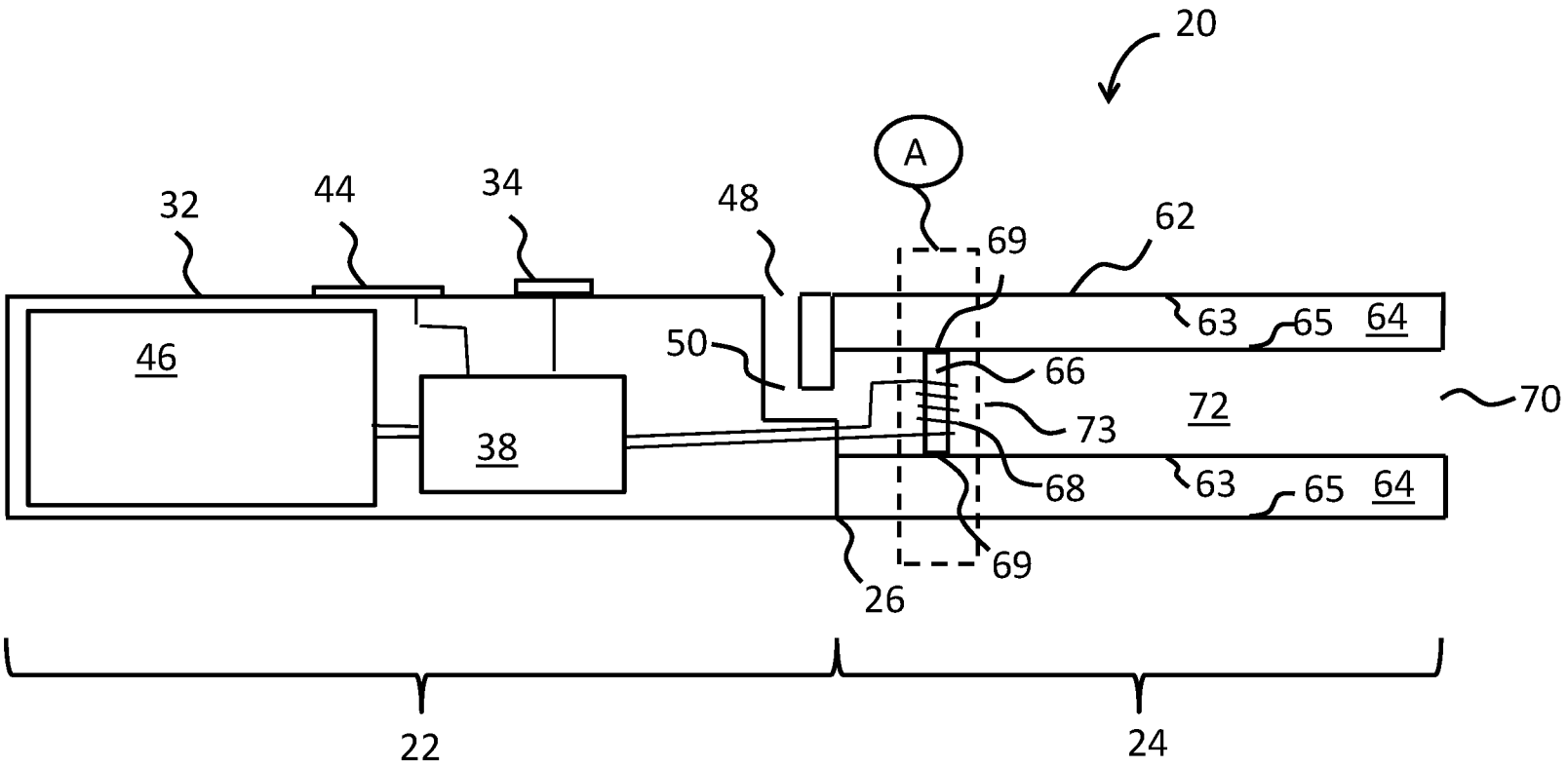
FIG. 1 shows a schematic cross-section of a vapor provision system.

Aspects and features of certain examples and embodiments are described herein. Some aspects and features of certain examples and embodiments may be implemented conventionally and these are not described in detail in the interests of brevity. It will thus be appreciated that aspects and features of apparatus and methods discussed herein which are not described in detail may be implemented in accordance with any conventional techniques for implementing such aspects and features.

The present disclosure relates to vapor provision systems, which may also be referred to as aerosol provision systems, such as e-cigarettes. Throughout the following description the term "e-cigarette" or "electronic cigarette" may sometimes be used, but it will be appreciated this term may be used largely interchangeably with vapor provision system/device and electronic vapor provision system/device. Furthermore, and as is common in the technical field, the terms "vapor" and "aerosol", and related terms such as "vaporize", "volatilize" and "aerosolize", may generally be used interchangeably.

In addition, vapor provision systems and/or devices are often provided in modular form, for example, as a control unit and a cartomizer (a combination of a cartridge and a vaporizer). The terms vapor provision system and vapor provision device are also used herein to denote one or more modules that act to generate a vapor, even such a system/device may not represent a complete e-cigarette (for example, because it is configured to receive a separate module containing liquid to be vaporized).

Vapor provision systems (e-cigarettes) often, although not always, comprise a modular assembly having a reusable part (control unit part) and a replaceable (disposable) cartridge part. The replaceable cartridge part usually comprises the vapor precursor material and the vaporizer, and the reusable part usually comprises the power supply, for example rechargeable battery, and control circuitry. It will be appreciated these different parts may comprise further elements depending on functionality. For example, the reusable device part may comprise a user interface for receiving user input and displaying operating status characteristics, and the replaceable cartridge part may comprise a temperature sensor for helping to control temperature.

Cartridges are usually electrically and mechanically coupled to a control unit for use, for example by a screw thread, latching or bayonet fixing with appropriately engaging electrical contacts. When the vapor precursor material in a cartridge is exhausted, or the user wishes to switch to a different cartridge having a different vapor precursor material, a cartridge may be removed from the control unit and a replacement cartridge attached in its place. Devices conforming to this type of two-part modular configuration may generally be referred to as two-part devices. Some of the examples described herein comprise a generally elongate two-part device employing disposable cartridges, but it will be appreciated the approach described herein may also be adopted for different configurations of electronic cigarette, for example single-part devices or modular devices comprising more than two parts, refillable devices and single-use disposable devices, likewise for devices conforming to other overall shapes, for example based on so-called box-mod high performance devices that typically have more of a box-like shape.

FIG. 1 is a cross-sectional view through an example e-cigarette 20. The e-cigarette 20 comprises two main components, namely a reusable part 22 and a replaceable (disposable) part 24 (often termed a cartridge). In normal use, the reusable part 22 and the cartridge part 24 are releasably coupled together at an interface 26. When the cartridge part 24 is exhausted or the user simply wishes to switch to a different cartridge part, the cartridge part 24 may be removed from the reusable part 22 and a replacement cartridge 24 attached to the reusable part 22 in its place. The interface 26 often provides a structural (mechanical), electrical and airflow path connection between the two parts, and may be established for example using a screw thread, a latch mechanism, or a bayonet fixing. The interface 26 also provides appropriately arranged electrical contacts and openings for establishing electrical connection and an airflow path between the two parts as appropriate.

In some implementations, the interface 26 may not support an electrical and/or airflow path connection between the respective parts. For example, in some implementations a vaporizer may be provided in the reusable part 22 rather than in the cartridge part 24, or the transfer of electrical power from the reusable part 22 to the cartridge part 24 may be wireless (for example based on electromagnetic induction), so that an electrical connection between the reusable part 22 and the cartridge part 24 is not needed. Furthermore, in some implementations the airflow through the electronic cigarette 20 might not go through the reusable part 22, so that no airflow path connection between the reusable part 22 and the cartridge part 24 is needed.

In the example of FIG. 1, the cartridge part 24 comprises a cartridge housing 62 of plastic. The cartridge housing 62 supports other components of the cartridge 24 and provides the mechanical interface 26 with the reusable part 22. The cartridge housing 62 may be circularly symmetric about a longitudinal axis along which the cartridge part 24 couples to the reusable part 22 (although other geometries are widely adopted as well).

Within the cartridge housing 62 is a reservoir 64 that contains liquid vapor precursor material, which may be referred to as e-liquid. The liquid reservoir 64 in this example has an annular shape which is circularly symmetric. In particular, the reservoir 64 is defined by an outer wall 65, provided by the cartridge housing 62, and an inner wall 63 that also defines an airflow path or airflow channel 72 through the cartridge part 24. In other words, the inner wall 63 separates the airflow channel 72 from the reservoir. The reservoir 64 is closed at each end to retain the e-liquid.

The cartridge 24 further comprises a wick (liquid transport element) 66 and a heater (vaporizer) 68. In the example shown in FIG. 1, the wick 66 extends transversely across the cartridge airflow channel 72, i.e. perpendicular to the longitudinal direction of the e-cigarette 20 (and also perpendicular to the airflow direction along channel 72). Each end of the wick is configured to draw liquid from the reservoir 64 through one or more openings in the inner wall 63. The e-liquid infiltrates the wick 66 and is drawn along the wick 66 by surface tension/capillary action (i.e. wicking). The configuration of the wick 66 is described in more detail below.

The wick 66 and heater 68 are arranged in the cartridge airflow channel 72 such that a region of the cartridge airflow channel 72 around the wick 66 and heater 68 in effect defines a vaporization region (vapor generation chamber) 73 for the cartridge. The location of the vapor generation chamber 73 is indicated approximately in FIG. 1 by dashed-line box A.

The heater 68 may comprise an electrically resistive wire coiled around the wick 66, for example a nickel chrome alloy (Cr20Ni80) wire, and the wick 66 may comprise a glass fiber bundle, but many other options will be apparent to the skilled person. For example, the wick might be a cotton fiber bundle or made of ceramic.

In use electrical power is supplied to the heater 68 to vaporize an amount of e-liquid (vapor precursor material) drawn to the vicinity of the heater 68 by the wick 66. Vaporized e-liquid may then become entrained in air drawn along the cartridge airflow channel 72 from the vaporization region 73 towards the mouthpiece outlet 70 for user inhalation.

Although the vapor generation chamber 73 of FIG. 1 lies within airflow channel 72, this is not necessarily the case. For example, the vapor generation chamber 73 may be offset from (and outside) the main airflow channel, but connected to the main airflow channel by one or more side channels that feed vapor from the vapor generation chamber into the main airflow channel. In another implementation, the vapor generation chamber may feed vapor directly to the mouthpiece 70 (where the vapor may potentially then be mixed with air for inhalation). The skilled person will be aware of other possible implementations.

The rate at which e-liquid is vaporized by the vaporizer (heater) 68 generally depends on the amount (level) of power supplied to the heater 68. Accordingly, in some devices, the rate of vapor generation (vaporization rate) can be set by changing the amount of power supplied to the heater 68 (for example through pulse width and/or frequency modulation techniques).

The reusable part 22 shown in FIG. 1 comprises an outer housing 32 with an opening that defines an air inlet 48 for the e-cigarette, a battery 46 for providing electrical power to operate the electronic cigarette, control circuitry 38 for controlling and monitoring the operation of the electronic cigarette, a user input button 34 and a visual display indicator 44. The outer housing 32 has a cross-section generally conforming to the shape and size of the cartridge part 24 so as to provide a smooth transition between the two parts at the interface 26.

The air inlet 48 connects to an airflow path 50 through the reusable part 22. The reusable part airflow path 50 in turn connects to the cartridge airflow channel 72 across the interface 26 when the reusable part 22 and cartridge part 24 are connected together. Thus, when a user inhales on the mouthpiece opening 70, air is drawn in through the air inlet 48, along the reusable part air path 50, through the interface 26, through the vapor generation region 73 in the vicinity of the atomizer 68 (where vaporized e-liquid becomes entrained in the air flow), along the cartridge airflow channel 72, and out through the mouthpiece opening 70 for user inhalation.

The battery 46 is usually rechargeable, for example through a charging connector in the reusable part housing 32, such as a USB connector (not shown). The user input button 34 may be used to perform various control functions. The display 44 may (for example) comprise one or more LEDs that are arranged to display appropriate information, for example about the charge status of the battery. The control circuitry 38 is suitably configured (programmed) to control the operation of the electronic cigarette, for example to regulate the supply of power from the battery 46 to the heater 68.

Figure 2:
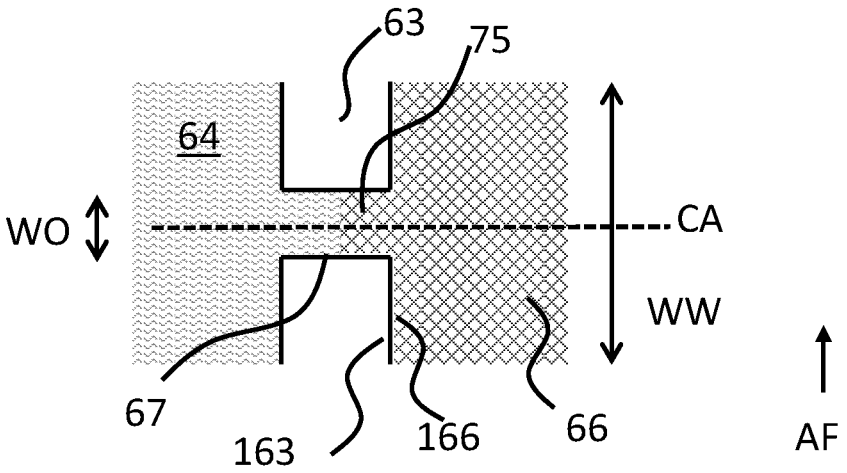
FIG. 2 shows a schematic cross-section of an example coupling between the wick and liquid reservoir for a vapor provision system as described herein.

FIG. 2 schematically shows an example of how the wick 66 is coupled to the liquid reservoir 64. In particular, FIG. 2 shows the inner wall 63 including a hole or opening 67. On one side of the opening 67 (and wall 63) is the liquid reservoir 64, on the other side is the wick 66 located in the vapor generation chamber 73. The longitudinal direction of the device, parallel to the airflow, is indicated by arrow AF in FIG. 2; the flow of liquid through the opening 67 from the reservoir 64 to the wick 66 will be referred to as the transverse direction (and is perpendicular to the longitudinal direction AF).

The wick 66 is shown to abut the wall 63 around the opening 67 in FIG. 2. In particular, the wall 63 has a surface 163 that is normal to the transverse direction (as defined above) and surrounds the opening 67; put another way, the surface 163 extends radially outwards from the opening 67. The wick likewise has a surface 166 that is normal to the transverse direction and surrounds opening 67 (so again, surface 166 can be considered as extending radially outwards from the opening 67). The wick surface 166 is therefore parallel to the wall surface 163, and these two surfaces abut one another as shown in FIG. 2.

This configuration helps to prevent leakage into the airflow path of liquid that passes through opening 67 from the reservoir to the wick, in that having wick surface 166 abut against wall surface 163 acts as a form of seal around opening 67. In other words, for the configuration of FIG. 2, there is a much better chance that liquid which flows from the reservoir 64 through opening 67 is retained within the wick, rather than escaping from around the outside of wick 66.

It will be appreciated that the wick surface 166 is configured to abut against wall surface 163 by providing a wick 66 with a greater cross-sectional size (for example diameter) than the hole 67 (the cross-sectional size is measured in a plane perpendicular to the transverse direction as defined above). In FIG. 2, the size of the opening 67 is indicated by arrow WO, and the size of the wick 66 is indicated by arrow WW—the former being clearly smaller than the latter. One way of looking at this is to define a central axis (denoted CA in FIG. 2 and shown as a dashed line) through opening 67. The central axis CA is parallel to the transverse direction. The wick 66 then extends further in a radial direction from the central axis than the opening 67 does (for all azimuthal angles with respect to the central axis). Consequently, the region of overlap or abutment between wick surface 166 and wall surface 163 extends fully around the perimeter of hole 67 (irrespective of the exact shape of this perimeter—for example square, circular, etc.).

In the example of FIG. 2, the wick 66 part-way extends into the opening 67. In particular, the portion of the wick 66 extending into the opening 67 is indicated in FIG. 2 as end portion 75. While the cross-sectional area of the wick 66 in the vapor generation channel 73 is greater than the cross-sectional area of the opening 67, it will be appreciated that the cross-sectional area of the end portion 75 is smaller than or equal to the cross-sectional area of the opening 67 (to allow the end portion 75 to fit into opening 67). Note that in some cases the wick might be slightly compressible to facilitate insertion into the opening 67.

Wick 66 can be considered as having a step transition at the join between end portion 75 and wick surface 166, i.e. the wick 66 has a step decrease in size from WW to WO at this point. Consequently, within opening 67, the end portion 75 of the wick 66 has a first cross-sectional profile, while external to the opening 67, i.e. within the vapor generation region, the wick 66 has a second (larger) cross-sectional profile.

Although FIG. 2 shows that the end portion 75 of the wick 66 extends part-way into the opening 75, in other implementations, the end surface of the wick 66 may not extend at all into the opening 67. In such a configuration, the end of the wick may be completely flush with wall surface 163 (including across opening 67). Alternatively, the end portion 75 of the wick may extend along the full length of the opening 67 (along the central axis CA), in some cases extending beyond opening 67 into liquid reservoir 64. This will then provide an increased surface area of the wick 66 in the liquid reservoir 64, which may in turn increase the wicking rate.

Having a portion of the wick extend at least partly into (and potentially through) opening 67 can help to control the flow of liquid from reservoir 64 through opening 67, which may in turn help to reduce leakage of liquid through opening 67 into the vapor generation chamber 73. In addition, having a portion of the wick extend at least partly into (and potentially through) opening 67 may help to locate and/or retain and/or support the wick within the vapor generation chamber 73.

In some implementations, the wick 66 may be pressed against the inner wall 63, i.e. at least part of the wick surface 166 is pressed against the wall surface 163. Holding the wick surface 166 tightly against the wall surface 163 can help, in effect, to provide a better seal around the opening 67 and so in turn help to reduce leakage. One way to have the wick surface 166 pressed against the wall surface 163, where wall 63 defines an inner tube, is with the wick 66 extending fully across the diameter (width) of the inner tube (such as shown in FIG. 1). An opening 67 may be provided on opposing sides of the inner tube, such that each end of the wick can be coupled through the wall 63 into the reservoir 64, such as by the coupling shown in FIG. 2. In such a configuration, if the length of the wick is slightly greater than the width across the inner tube (both being measured parallel to the central axis), then the wick is held under slight compression, thereby creating a pressure between wick surface 166 and wall surface 163.

Figure 3:
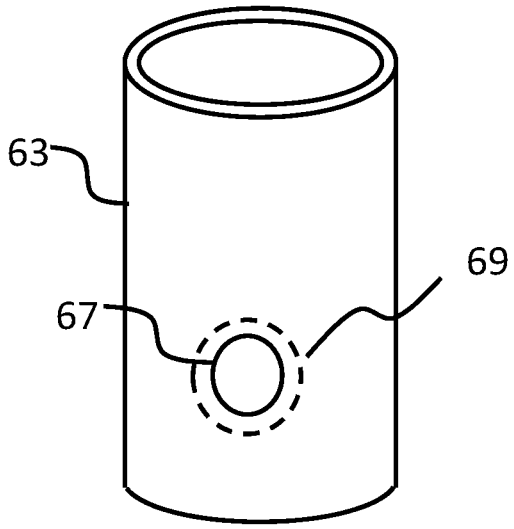
FIG. 3 shows a schematic view of the coupling of FIG. 2, as seen from outside the vapor generation chamber.

FIG. 3 shows a schematic view of the coupling shown in FIG. 2, as seen from outside the vapor generation chamber and inner wall 63. This view shows the opening 67 in wall 63, and further includes dashed line 69, which denotes the extent of the wick surface 166 inside tube wall 63. In other words, the opening 67 has a diameter corresponding to WO in FIG. 2, while dashed line has a diameter corresponding to WW in FIG. 2. It can be seen that the wick surface 166 extends fully around the opening 67 (i.e. around the perimeter or circumference of opening 67), thereby acting as a seal against leakage of liquid into the vapor generation chamber 73.

Figure 4A:
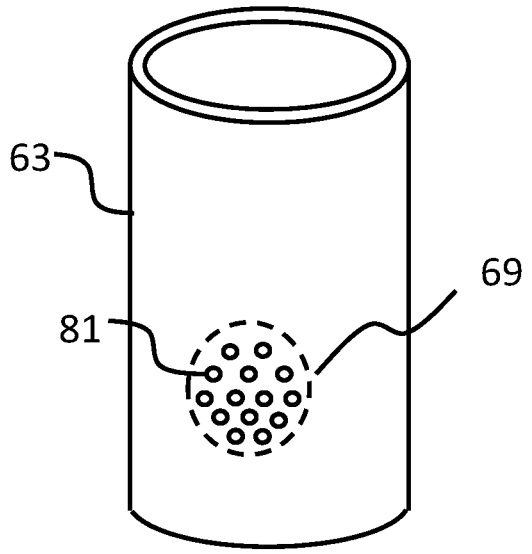
FIGS. 4A and 4B show schematic views of alternative couplings between the wick and the liquid reservoir, as seen from outside the vapor generation chamber.
Figure 4B:
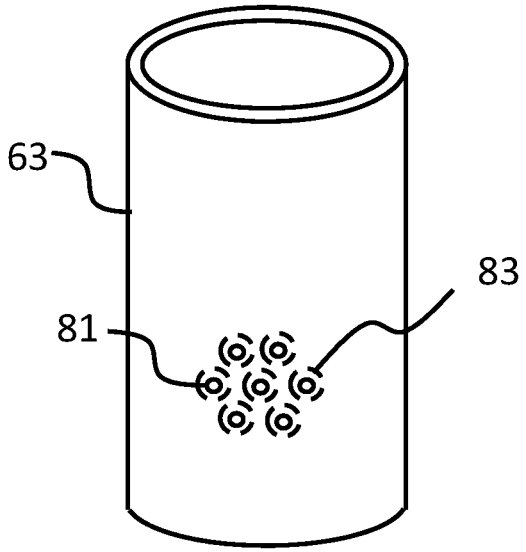

Although the wall 63 in FIG. 3 has just a single opening 67 (at any given end of the wick), in other implementations there may be a cluster of multiple openings to couple the reservoir to the wick (in particular, to any given end of the wick). FIGS. 4A and 4B show two such configurations for the coupling between the reservoir 64 and the wick 66, each such coupling comprising multiple holes 81. In FIG. 4A, the dashed line 69 surrounds the plurality of openings 81 (the dashed line 69 again denoting the region of wick surface 166 in contact with the wall surface 163, on the inside of inner tube 63).

FIG. 4B likewise shows a plurality of opening 81 in the tube 63. However, for the configuration of FIG. 4B, each opening is surrounded by a respective dashed line 83, which denotes the region of wick surface 166 in contact with the wall surface 163, on the inside of inner tube 63 (analogous to dashed line 69 in FIG. 4A). This configuration can be consider as formed by a wick 66 that splits into a plurality of strands, with each strand being coupled to the liquid reservoir 64 according to the approach shown in FIG. 2, i.e. with the size of each strand being greater than the size of the respective opening to which the strand is coupled.

Note that the smaller size of the openings 81 in FIGS. 4A and 4B may increase the surface tension associated with such openings, which in turn can help reduce leakage of liquid through such openings 81. For example, liquid might only be able to leave the reservoir through one of the openings 81 when specifically drawn by the wick 66, the capillary action of the wick overcoming the surface tension associated with the opening. This capillary action is promoted by allowing the meniscus of the liquid in the reservoir to physically contact the wick 66 (for example the end portion 75 thereof).

In such a configuration, the overall number and size of the multiple openings 81 can then be arranged to support a desired rate of liquid transfer from the liquid reservoir 64 to the wick 66 (and hence for supply to the vaporizer), for example a comparable rate to that achieved by the coupling of FIGS. 2 and 3. In some implementations, the openings 81 may have a diameter between 0.01 mm and 0.3 mm, and preferably a diameter between 0.05 mm and 0.2 mm. Furthermore, the holes may be arranged in any appropriate pattern; for example, the holes 81 may be arranged in a linear, hexagonal or concentric pattern. In example implementations, the number of openings may be greater than 3, and preferably greater than 8.

It will be appreciated that in any given implementation, the surface tension associated with the multiple openings 81, and the flow rate through such multiple openings, will depend on a number of factors, including the nature of the liquid in liquid reservoir 64 and the size and shape of the openings 81 (in respect of surface tension) and further including the material of the wick and the number of openings 81 (in respect of the overall flow rate). The appropriate parameters can be determined experimentally for any given configuration. For example, for a given liquid (or set of liquids), different sizes can be tried for openings 81 to find the largest size for which surface tension still prevents the flow of liquid through the openings (absent the insertion of a wick 66, in particular the end portion 75 thereof). In addition, testing such different size holes can also find the smallest size suitable to maintain the desired flow of liquid through wick 66, in effect, to ensure that wick 66 does not dry out and/or that a desired rate of vaporization can be supported.

Figure 5A:
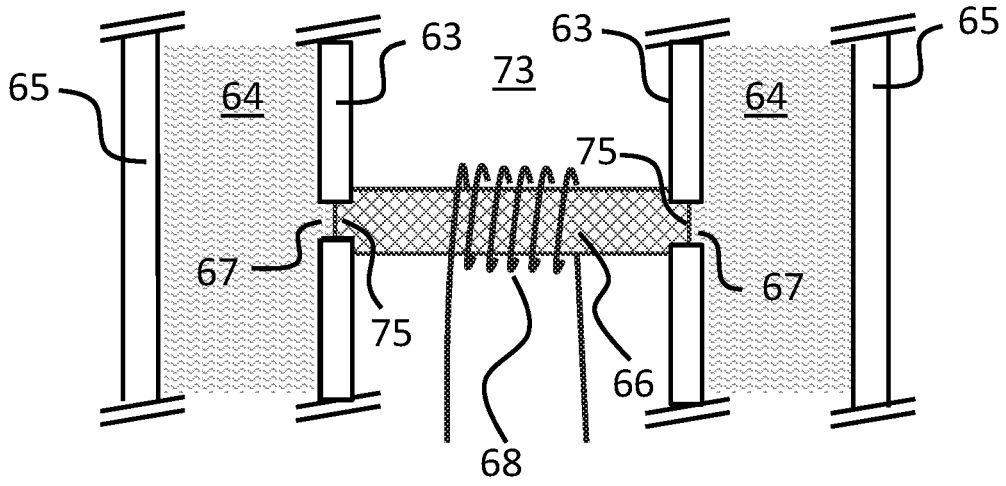
FIGS. 5A and 5B illustrate two approaches for implementing the coupling between the liquid reservoir and the wick of FIG. 2 in an e-cigarette such as shown in FIG. 1.
Figure 5B:
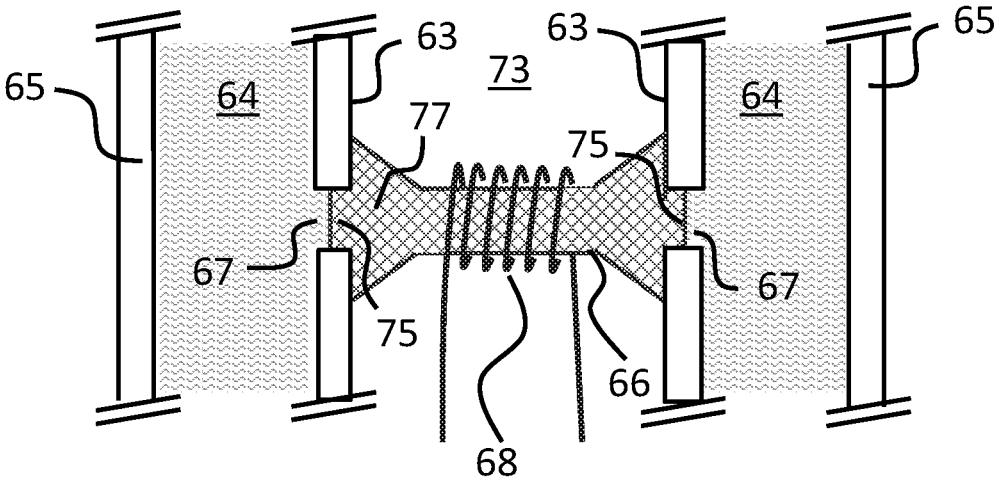

FIGS. 5A and 5B illustrate two approaches for implementing the coupling between the liquid reservoir and the wick of FIG. 2 in an e-cigarette such as shown in FIG. 1. These Figures schematically show a cross-section of a portion of the electronic cigarette 20 in the vicinity of its vapor generation chamber 73, i.e. where vapor is generated during use. Broadly speaking, the portion of the electronic cigarette 20 represented in FIGS. 5A and 5B corresponds to the region identified by the dashed-line box labelled A in FIG. 1. Thus this portion of the electronic cigarette 20 includes (sections of) the outer wall 65, the inner wall 63, and the liquid reservoir 64, as well as the wick 66 and vaporizer (heating coil) 68. The inner wall 63 comprises a pair of openings 67 on opposite sides of the device. At each opening 67, a respective end of the wick 66 is coupled through the opening to the liquid reservoir 64 using a coupling corresponding to that shown in FIG. 2. The wick 66 is generally aligned with the central axis CA shown in FIG. 2. The wick may have any suitable cross-sectional shape (for example circular, square, elliptical, etc) in a plane normal to this central axis. As described earlier, the wick 66 abuts the inner wall 63 around the opening, thereby acting as a seal to help reduce leakage of liquid from the liquid reservoir 64 into the vapor generation chamber 73.

The wick includes, at each end, an end portion 75 of reduced width, which allows the end portion to extend into opening 67. The end portion will typically have a width and cross-sectional shape matching that of the opening 67. As mentioned above, the wick may be slightly compressible to facilitate insertion of the end portion into the opening 67. This may also help to retain the wick 66 in position with respect to the vapor generation chamber 73. Alternatively (or additionally), the wick 66 may be supported by some other facility, for example, the wick 66 might be supported on the heater coil 68.

The implementation of FIG. 5B is generally the same as that of FIG. 5A, except that in FIG. 5A, the wick 66 has a substantially uniform cross-section or profile (apart from end portions 75), while in the example of FIG. 5B, the wick 66 flares outwardly (away from the central axis) travelling along the wick from its center point, i.e. away from the heater 68 towards the inner wall 63. As a result, at each end the wick includes a flared portion 77 which has a greater cross-sectional area than a portion of the wick enclosed within heater 68.

It will be appreciated that the flared region 77 increases the width of the wick (WW) relative to the width of the opening (WO), and so increases the area of the wick surface 166 that abuts against the surface of the inner wall 163 (i.e. it increases the size indicated by dashed line 69 in FIG. 3). This larger area of contact between the wick surface 166 and the inner wall surface 163 can help to further reduce leakage of liquid into the vapor generation chamber 73. Note that although the flared region 77 is shown as gradually increasing in width, in other configurations there might be a step transition to a greater width, or any other suitable arrangement.

In addition, the flared region 77 supports a higher transfer rate of liquid from the liquid reservoir 64 to the portion of the wick 66 adjacent to the heater 68. This can also help to reduce leakage into the vapor generation chamber 73, for example, because there is less risk of the wick becoming saturated with liquid, and/or because the lower relative concentration of liquid within the wick supports a stronger capillary action. The higher transfer rate of liquid may also be desirable to support a greater rate of vaporization from the wick 66 by the heater 68.

FIGS. 6A, 6B and 6C again show a region corresponding to dashed-line box A in FIG. 1, and illustrate three further approaches for implementing the coupling between the liquid reservoir and the wick in an e-cigarette. In these Figures, at each end of the wick 66, the inner wall 63 is provided with multiple openings 81 into the liquid reservoir 64. Each of the plurality of openings 81 occurs within a region corresponding to the cross-sectional shape of the wick 66. Accordingly, these arrangements correspond generally to those shown in FIGS. 4A and 4B.

At each of the plurality of openings 81, the wick 66 is coupled to the liquid reservoir 64 such that liquid from the reservoir 64 may pass through the openings 81 in inner wall 63 to the wick 66. The wick 66 may include a plurality of end portions 75, as discussed above, each of which extends at least partially into a respective opening.

Figure 6A:
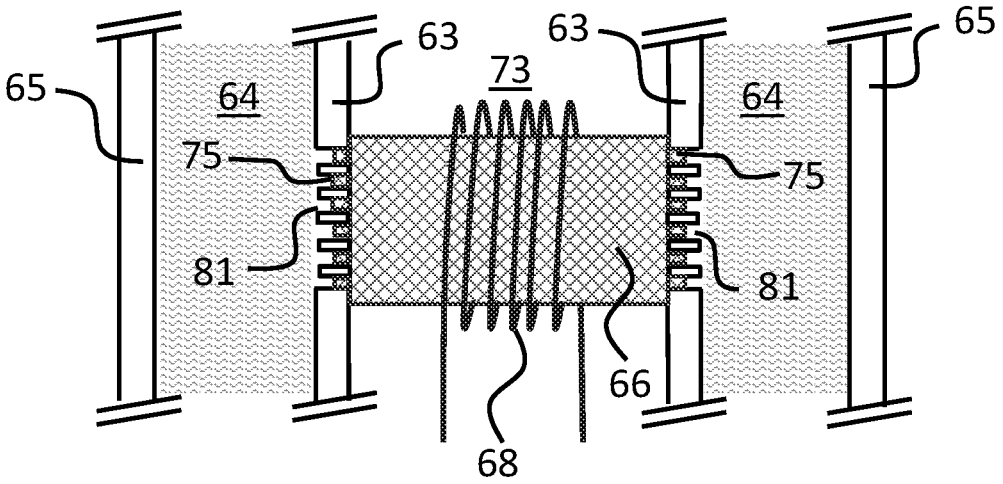
FIGS. 6A, 6B and 6C illustrate three further approaches for implementing the coupling between the liquid reservoir and the wick in an e-cigarette such as shown in FIG. 1.

The configuration shown in FIG. 6A corresponds generally to the configuration shown in FIG. 4A, in that there are multiple openings 81. The wick 66 then abuts the wall 63 in a substantially continuous region that encompasses all the openings 81, plus an outer or circumferential margin. The wick may be provided with end portions 75 that extend into at least some of the openings. As described above, this configuration acts to reduce liquid leakage into the vapor generation chamber, at least in part because the wick 66 acts as a seal around openings 81.

In some implementations, the wick 66 may be constructed such that the cumulative cross-sectional area of the plurality of end portions in respective openings 81 is broadly equal to or greater than the cross-sectional area of the wick adjacent to the heater 68. Such an arrangement may help to support a more consistent the liquid flow rate into and through the wick to the heater 68.

Figure 6B:
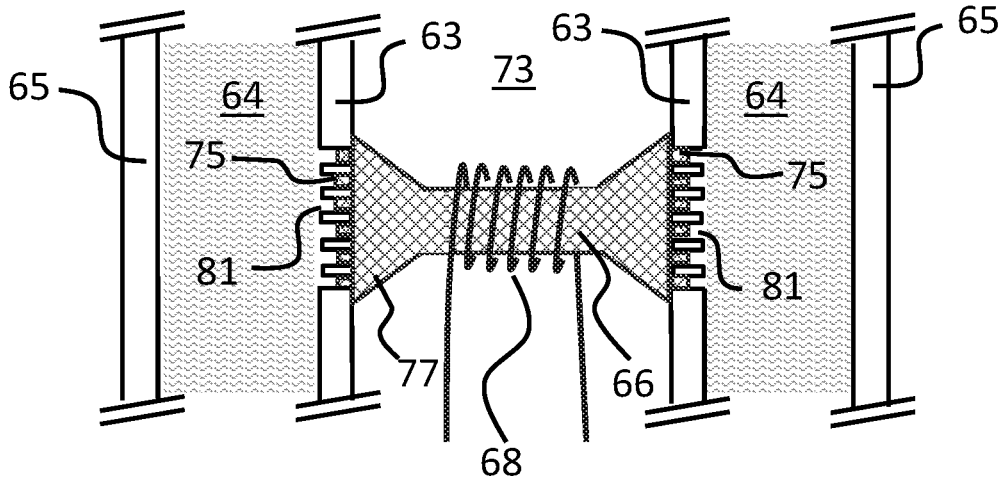

The configuration of FIG. 6B is generally similar to the configuration of FIG. 6A, except that adjacent the inner wall 63, the wick 66 flares 77 outwards (away from the central axis CA). It will be appreciated that this flaring can help to further reduce or prevent leakage, as discussed above in relation to FIG. 5B.

Figure 6C:
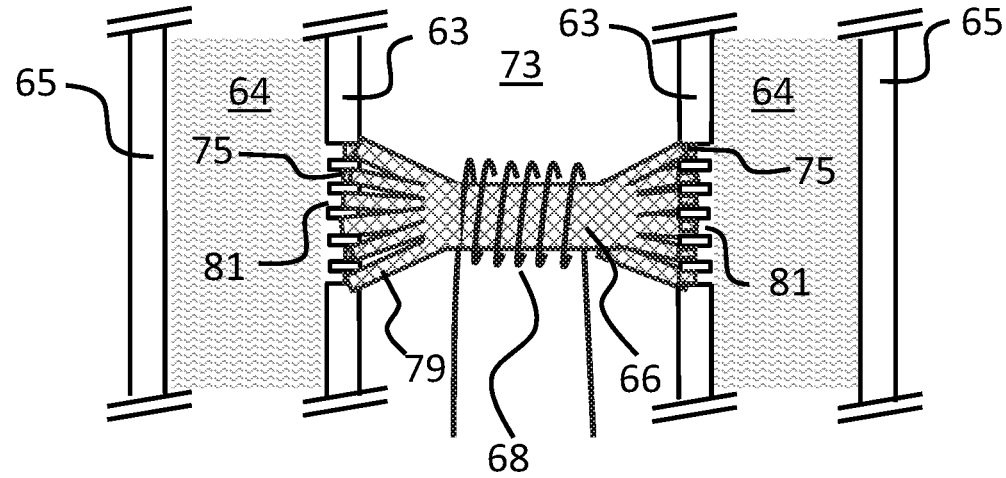

FIG. 6C shows another example configuration of an electronic cigarette 20 in the vicinity of its vapor generation chamber 73. In this configuration, near the inner wall 63, the wick separates into a plurality of strands 79, each of which corresponds to a separate one of the plurality of openings 81. Accordingly, liquid is transported from the reservoir 64 to the vaporizer 68 through the openings 81 by the strands 79. An end portion of some or all the strands 79 may extend into (or pass through) their respective openings 81. Some or all of the strands may also have a flared portion, analogous to the shape shown in FIG. 6B.

The wick 66 may have a fairly solid central portion (i.e. adjacent to the heater); however, away from the heater 68, the wick splits into the separate strands 79. There may be small gaps between the different strands, such as shown in FIG. 6C. In some examples, the plurality of strands 79 of the wick 66 may be twisted in a bundle in the central portion of the wick and untwisted close to the wall 63 to allow the separation shown in FIG. 6C. The coil heater 68 may potentially act to hold the bundle together in the desired position. Note that the wick 66 may be formed of many fibers, so that each strand 79 comprises a subset of these fibers.

Note that the configuration of FIG. 6C generally corresponds to that shown in FIG. 4B, where it can be seen that the size of each strand is greater than the size of the corresponding opening. In other words, the strands generally surround their respective openings 81 to provide a sealing effect (in substantially the same manner as shown in FIG. 2 for a single, integral wick).

While the above-described examples have in some respects focused on some specific example vapor provision systems, it will be appreciated the same principles can be applied to vapor provision systems using other technologies.

For example, the vapor provision systems described above have a central airflow passage surrounded by the liquid reservoir, however, many other relative arrangements for the airflow passage and the liquid reservoir are known—for example, the airflow passage may be outside, or to one side of the liquid reservoir, and/or the airflow passage may be longitudinally displaced from the liquid reservoir. In addition, in the vapor provision systems described above, the airflow passage and the liquid reservoir are separated by a single wall; however, in other systems, they may be separated by additional components. In addition, in the vapor provision systems described above, the liquid transport element or wick is typically coupled to the reservoir at each end, so that there are two couplings of the liquid transport element to the reservoir (one at each end). However, in other implementations, only a single end (or single portion) of the liquid transport element may be coupled to the reservoir. Alternatively, there may be more than two couplings of the liquid transport element to the reservoir—for example if the liquid transport element is formed of two interconnected or intertwined wicks, or a wick having multiple arms (for example in a cross-like configuration), each of which is connected individually to the liquid reservoir. Note also that in some devices, there may be multiple separate liquid reservoirs (for example providing different flavors), and one or more of these reservoirs may be linked to a vaporizer using a liquid transport element as described herein. In addition, the liquid transport element described herein is generally formed using a relatively long, thin flexible wick, formed for example of fibrous material, such as glass fiber or cotton. However, other forms of liquid transport element are known, and could be used instead, for example a wick made out of a solid, such as a porous ceramic, or a metal (for example steel) mesh. These other forms of liquid transport element may have a variety of shapes, for example rectangular, planar, disk-like, etc.

Furthermore, the vapor provision systems described above include a vaporizer comprising a resistance heater coil. However, in other implementations, the vaporizer may comprise other forms of heater, for example a planar heater in contact with a liquid transport element. Furthermore, in other implementations a heater-based vaporizer might be inductively heated, or may use some other vaporization technology (rather than heating), for example piezoelectric excitement. In addition, it will be appreciated that the aerosol (vapor) provision systems described above primarily comprise a two-part device, the same approach may be applied in respect of other formats, including three-part devices (for example where the reservoir may be in a separate module from the vaporizer), or single module, refillable or one-time use devices that do not have a separable cartridge.

Furthermore, the e-cigarette (vapor provision system) 20 described above includes a liquid reservoir 64. In some implementations, a vapor provision device may be provided without a liquid reservoir, but may be configured to receive such a liquid reservoir. For example, the liquid reservoir might be formed as a removable or replaceable cartridge that can be fitted to (in) the vapor provision device; this may allow the cartridge to be replaced for example when the reservoir is depleted, or if a change of vapor flavor is desired. The combination of the vapor provision device with the received liquid reservoir can then be regarded as a vapor provision system as disclosed herein.

In order to address various issues and advance the art, this disclosure shows by way of illustration various embodiments in which the claimed invention(s) may be practiced. The advantages and features of the disclosure are of a representative sample of embodiments only, and are not exhaustive. They are presented only to assist in understanding and to teach the claimed invention(s). It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope of the claims. Various embodiments may suitably comprise, consist of, or consist essentially of, various combinations of the disclosed elements, components, features, parts, steps, means, etc. other than those specifically described herein, and it will thus be appreciated that features of the dependent claims may be combined with features of the independent claims in combinations other than those explicitly set out in the claims.

The invention claimed is:

1. A vapor provision system comprising:

a vapor generation chamber;

a reservoir containing a liquid;

a vaporizer located in the vapor generation chamber; and a liquid transport element arranged to transport the liquid from the reservoir through an opening in a wall of the vapor generation chamber to the vaporizer, wherein the liquid transport element in the vapor generation chamber has a cross-sectional area which is greater than a cross-sectional area of the opening, and wherein a surface of the liquid transport element in the vapor generation chamber is parallel to and abuts a surface of the wall surrounding the opening to help prevent leakage, and wherein the liquid transport element extends into the opening and the liquid transport element in the vapor generation chamber comprises an outwardly flared portion which abuts the wall surrounding the opening.

2. The vapor provision system of claim 1, wherein the liquid transport element extends through the opening and into the reservoir.

3. The vapor provision system of claim 1, wherein the cross-sectional area of the liquid transport element has a transition from a first cross-sectional area in the vapor generation chamber to a second cross-sectional area in the opening, wherein the second cross-sectional area is smaller than or equal to the cross-sectional area of the opening.

4. The vapor provision system of claim 3, wherein the transition of the liquid transport element from the first cross-sectional area to the second cross- sectional area comprises a step having a surface which is parallel to and abuts against the wall surrounding the opening.

5. The vapor provision system of claim 1, wherein the vapor provision system comprises a plurality of openings in the wall of the vapor generation chamber, the liquid transport element being arranged to transport the liquid from the reservoir through the plurality of openings to the vaporizer.

6. The vapor provision system of claim 5, wherein the liquid transport element is split, between the vaporizer and the plurality of openings, into a plurality of separate strands, each of the plurality of separate strands being arranged to transport the liquid from the reservoir to the vaporizer through a respective opening of the plurality of openings.

7. The vapor provision system of claim 6, wherein each of the plurality of separate strands extends into or passes through the respective opening for the strand.

8. The vapor provision system of claim 5, wherein a size of each of the openings is sufficiently small for surface tension of the liquid in the reservoir to prevent flow of the liquid through the openings in an absence of the liquid transport element.

9. The vapor provision system of claim 5, wherein the liquid transport element in the vapor generation chamber abuts the wall between the openings to help prevent leakage.

10. The vapor provision system of claim 5, wherein the plurality of openings comprises more than 3 openings.

11. The vapor provision system of claim 1, wherein the liquid transport element comprises a plurality of fibers.

12. The vapor provision system of claim 1, wherein the system is configured such that a liquid flow rate through the one or more openings, in combination, is approximately the same as or greater than a liquid flow rate along the liquid transport element in an airflow channel.

13. The vapor provision system of claim 1, wherein the liquid transport element comprises at least a first end and a second end, each of the at least the first end and the second end of the liquid transport element being arranged to transport the liquid from the reservoir to the vaporizer through a respective set of one or more openings in the wall of the vapor generation chamber.

14. The vapor provision system of claim 1, wherein the wall separates the reservoir from the vapor generation chamber to prevent the liquid in the reservoir from entering the vapor generation chamber except through one or more openings in the wall.

15. The vapor provision system of claim 1, wherein the vapor provision system is a cartridge configured to be coupled to a vapor provision system control unit for use.

16. The vapor provision system of claim 1, wherein the vapor provision system further comprises a control unit for supplying power and controlling operation of the vapor provision system.

17. The vapor provision system of claim 1, wherein the vapor generation chamber is formed in an airflow channel leading to a mouthpiece of the vapor provision device.

18. An electronic cigarette comprising the vapor provision system of claim 1.

19. A cartomizer for an electronic cigarette comprising the vapor provision system of claim 1.

20. A vapor provision device configured to receive a reservoir containing a liquid, the vapor provision device comprising:

a vapor generation chamber;

a vaporizer located in the vapor generation chamber; and a liquid transport element arranged to transport the liquid from the reservoir through an opening in a wall of the vapor generation chamber to the vaporizer , wherein the liquid transport element in the vapor generation chamber has a cross-sectional area which is greater than a cross-sectional area of the opening, and wherein a surface of the liquid transport element in the vapor generation chamber is parallel to and abuts a surface of the wall surrounding the opening to help prevent leakage, and wherein the liquid transport element extends into the opening and the liquid transport element in the vapor generation chamber comprises an outwardly flared portion which abuts the wall surrounding the opening.

* * * * *